US009645537B2

(12) United States Patent
Tamagaki et al.

(10) Patent No.: US 9,645,537 B2
(45) Date of Patent: May 9, 2017

(54) IMAGE FORMING APPARATUS CAPABLE OF DETECTING PRESENCE OR ABSENCE OF A CARTRIDGE OR A SHAPE OF THE CARTRIDGE WITHOUT INCREASING THE NUMBER OF COMPONENTS

(71) Applicant: CANON KABUSHIKI KAISHA, Tokyo (JP)

(72) Inventors: Kuniaki Tamagaki, Kawasaki (JP); Motoki Adachi, Ashigarakami-gun (JP); Satoshi Sunahara, Hachioji (JP); Takanori Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/730,803

(22) Filed: Jun. 4, 2015

(65) Prior Publication Data

US 2015/0355590 A1 Dec. 10, 2015

(30) Foreign Application Priority Data

Jun. 10, 2014 (JP) ..... 2014-120003

(51) Int. Cl.
*G03G 15/00* (2006.01)
*G03G 15/16* (2006.01)
*G03G 21/18* (2006.01)

(52) U.S. Cl.
CPC ..... *G03G 15/55* (2013.01); *G03G 15/5037* (2013.01); *G03G 15/1645* (2013.01); *G03G 21/1875* (2013.01); *G03G 2215/1614* (2013.01)

(58) Field of Classification Search
CPC . G03G 15/5037; G03G 15/55; G03G 21/1842
USPC ..... 399/13
See application file for complete search history.

(56) References Cited

U.S. PATENT DOCUMENTS 5,589,918 A * 12/1996 Oshida ..... G03G 21/181 399/114
5,768,659 A * 6/1998 Kameda ..... G03G 21/1896 399/111
8,983,310 B2 * 3/2015 Kanehara ..... G03G 15/0283 399/12
2007/0122199 A1 * 5/2007 Sugimoto ..... G03G 15/0121 399/227
2007/0140710 A1 * 6/2007 Okano ..... G03G 15/55 399/13
2007/0189782 A1 * 8/2007 Able ..... G03G 15/5037 399/13

(Continued)

FOREIGN PATENT DOCUMENTS

JP H01-263662 A 10/1989
JP H0990771 A 4/1997
JP 2014157186 A * 8/2014

*Primary Examiner* — Billy Lactaoen
*Assistant Examiner* — Arlene Heredia Ocasio
(74) *Attorney, Agent, or Firm* — Canon U.S.A., Inc. IP Division

(57) ABSTRACT

An image forming apparatus is provided that includes a light-emitting unit which emits light to an image bearing member which bears a developer image and that detects presence or absence of a developer container storing developer or a shape of the developer container on the basis of the number of electrons discharged from or received by the image bearing member when the light-emitting unit emits the light.

19 Claims, 7 Drawing Sheets

(56) References Cited

U.S. PATENT DOCUMENTS

| | | | | |
|---|---|---|---|---|
| 2009/0245817 | A1* | 10/2009 | Hamaya | G03G 21/1842 399/13 |
| 2013/0195471 | A1 | 8/2013 | Kanehara | |
| 2013/0279921 | A1* | 10/2013 | Kanai | G03G 15/50 399/12 |
| 2014/0093257 | A1* | 4/2014 | Seto | G03G 21/1892 399/25 |
| 2015/0117874 | A1* | 4/2015 | Shiraki | G03G 21/1676 399/13 |
| 2015/0220000 | A1* | 8/2015 | Suzuki | G03F 7/70141 355/67 |

* cited by examiner

IMAGE FORMING APPARATUS CAPABLE OF DETECTING PRESENCE OR ABSENCE OF A CARTRIDGE OR A SHAPE OF THE CARTRIDGE WITHOUT INCREASING THE NUMBER OF COMPONENTS

BACKGROUND OF THE INVENTION

Field of the Invention

The present invention relates to an electrophotographic image forming apparatus such as a copying machine and a printer. The electrophotographic image forming apparatus (hereinafter referred to as an "image forming apparatus") forms an image on a recording material, such as a sheet of paper, using an electrophotographic image forming method. The image forming apparatus may be, for example, a copying machine, a printer (a laser beam printer, a light-emitting diode (LED) printer, or the like), a facsimile apparatus, a word processor, or the like.

Description of the Related Art

First, by selectively emitting light to a photosensitive drum, which is an image bearing member uniformly charged by a charging device such as a charging roller, an image forming apparatus forms an electrostatic latent image on the photosensitive drum. The image forming apparatus then develops the electrostatic latent image to obtain a toner image by using a development device including a development roller and records the toner image by transferring the toner image onto a recording material. A cartridge removably attached to the image forming apparatus can be configured by integrating a photosensitive drum, a charging device, a development device, a cleaning device, and the like with one another. By using such a cartridge, it becomes easier to supply toner and replace or maintain various components that have reached their end of life, such as the photosensitive drum.

On the other hand, as a result of recent technological advances in extending lifespans of various components, toner containers require replacement more frequently than photosensitive drums or other components. A toner container, which needs to be replaced more frequently than other components, is therefore often separated from a cartridge.

If an image forming apparatus includes a plurality of cartridges, it needs to be detected, before an image is formed, whether all cartridges are correctly mounted on the image forming apparatus. If a toner cartridge is not mounted and an image is formed, toner is not supplied to a development device. In this case, a blank sheet might be output or, because of the lack of toner, friction between members will increase and a developer bearing member or the like might be damaged, thereby outputting a sheet on which vertical streaks are printed.

In Japanese Patent Laid-Open No. 1-263662, therefore, a nonvolatile memory is provided for each cartridge. Each nonvolatile memory is accessed at an arbitrary time in order to confirm that the corresponding cartridge is correctly mounted.

As another method, a configuration is known in which a mechanical lever sensor or an optical sensor is provided and the position of a switch changes when each cartridge is correctly mounted or when each cartridge is not mounted or is incorrectly mounted.

In the above example of the related art, however, a reading unit for a nonvolatile memory, a lever sensor, an optical sensor, or the like needs to be provided for the image forming apparatus, which undesirably increases the number of components and the cost.

SUMMARY OF THE INVENTION

The present invention provides an image forming apparatus capable of detecting presence or absence of a cartridge or a shape of the cartridge without increasing the number of components.

The present invention therefore provides an image forming apparatus including a light-emitting unit configured to emit light to an image bearing member that bears a developer image. Presence or absence of a developer container that stores developer or a shape of the developer container is detected on the basis of a number of electrons discharged from the image bearing member when the light-emitting unit emits the light.

The present invention also provides an image forming apparatus including a light-emitting unit configured to emit light to an image bearing member that bears a developer image. Presence or absence of a developer container that stores developer or a shape of the developer container is detected on the basis of a number of electrons received by the image bearing member when the light-emitting unit emits the light.

Further features of the present invention will become apparent from the following description of exemplary embodiments with reference to the attached drawings.

DESCRIPTION OF THE EMBODIMENTS

Exemplary embodiments of the present invention will be described in detail hereinafter with reference to the drawings. Each of the embodiments of the present invention described below can be implemented solely or as a combination of a plurality of the embodiments or features thereof where necessary or where the combination of elements or features from individual embodiments in a single embodiment is beneficial.

Dimensions, materials, shapes, and relative positions of components described in the embodiments, however, are appropriately selected in accordance with the configuration of an apparatus to which the present invention is applied. The scope of the present invention is therefore not limited to the following embodiments.

First Embodiment

A first embodiment of the present invention will be described.

Figure 1:
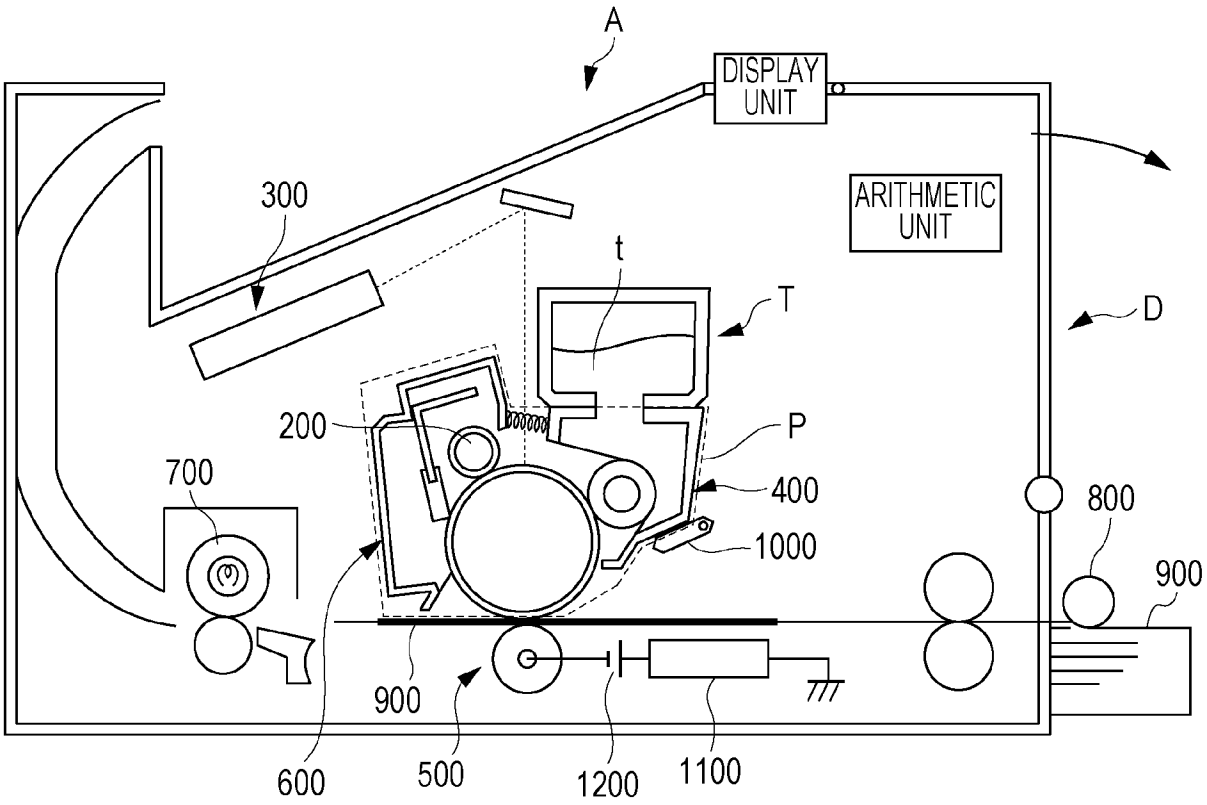
FIG. 1 is a schematic diagram illustrating the entirety of an image forming apparatus according to a first embodiment.
Figure 2A:
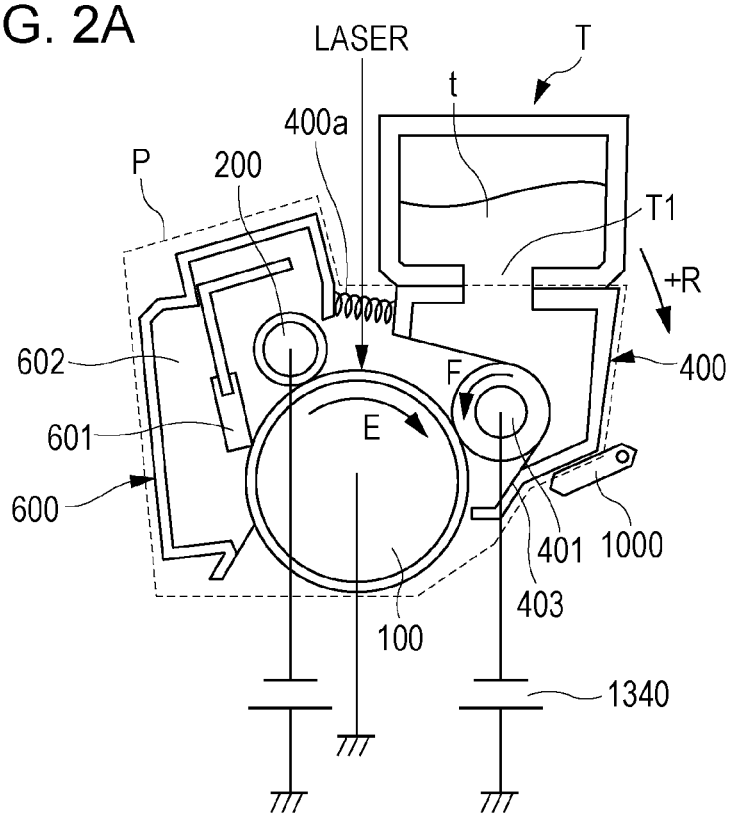
FIGS. 2A and 2B are schematic diagrams illustrating a process cartridge and a toner cartridge according to the first embodiment.
Figure 2B:
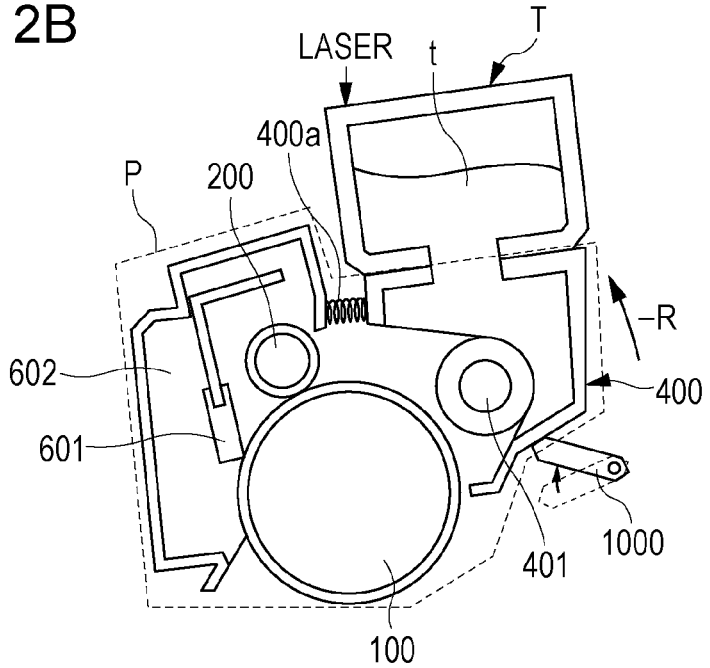

FIG. 1 is a schematic diagram illustrating an image forming apparatus A. FIGS. 2A and 2B are schematic diagrams illustrating a process cartridge P and a toner cartridge T according to the present embodiment.

The image forming apparatus A according to the present embodiment is an electrophotographic image forming apparatus that performs, on a photosensitive drum 100 as an image bearing member, a series of image forming processes including charging, emission of laser light, development, transfer, and cleaning to form an image on a recording material.

Here, the image forming apparatus A that performs the series of image forming processes includes the photosensitive drum 100 and a charging device (or a charging unit) including a charging roller 200 that uniformly charges a surface of the photosensitive drum 100. The image forming apparatus A also includes a light-emitting device 300 that emits laser light to the charged photosensitive drum 100 in accordance with image data to form an electrostatic latent image. The image forming apparatus A also includes a development device 400 whose development roller 401 as a developer bearing member comes into contact with the electrostatic latent image formed on the photosensitive drum 100 to transform the electrostatic latent image into a visible developer image by using developer on the developer bearing member. The image forming apparatus A also includes a transfer device 500 that transfers the developer image formed on the photosensitive drum 100 onto a recording material 900 such as a sheet of paper, a fixing device 700 that fixes a toner image on the recording material 900, and a cleaning device 600 that cleans the surface of the photosensitive drum 100 after the transfer.

The present invention is capable of detecting presence or absence of a developer container or a shape of the developer container on the basis of the number of electrons discharged from the image bearing member or the number of electrons received by the image bearing member. In the present embodiment, the transfer device (or a transfer unit) 500, which is an electron reception unit, receives electrons accumulated in the photosensitive drum 100 as the image bearing member. By detecting the current itself or a voltage, a current detection circuit 1100 then detects a current when the transfer device 500 receives electrons, in order to detect the presence or absence of the developer container or the shape of the developer container. An arithmetic unit, such as a central processing unit (CPU), in the image forming apparatus A determines presence or absence of the developer container or the shape of the developer container. Alternatively, however, presence or absence of the developer container or the shape of the developer container may be determined by transmitting an electrical signal, such as the current or the voltage, to an external personal computer or the like.

Overall Configuration of Image Forming Apparatus A

In the image forming apparatus A according to the first embodiment, the charging device, the light-emitting device 300, the development device 400, the transfer device 500, and the cleaning device 600 are arranged in this order around the photosensitive drum 100.

Figure 6:
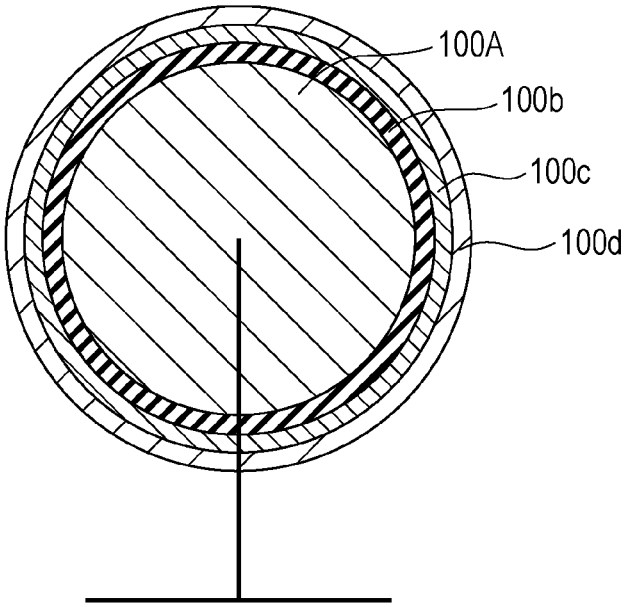
FIG. 6 is a schematic diagram illustrating a layered structure of a photosensitive drum according to the first embodiment.

The photosensitive drum 100 according to the present embodiment rotates in a direction indicated by an arrow E illustrated in FIG. 2A, and the development roller 401 forms an image by rotating in a direction indicated by an arrow F illustrated in FIG. 2A. The photosensitive drum 100 according to the present embodiment is a photosensitive drum in which, as illustrated in FIG. 6, an insulating layer 100*b*, a charge generation layer 100*c*, and a charge transfer layer 100*d* are stacked in this order on a conductive drum cylinder 100A. The charging roller 200 is in contact with the photosensitive drum 100 and rotates in synchronization with the photosensitive drum 100. A certain charging bias is applied to the charging roller 200, which is a charging unit, and the charging roller 200 uniformly charges the surface of the photosensitive drum 100 whose drum cylinder 100A is grounded. The light-emitting device 300 outputs laser light modulated in accordance with image data. Although laser light is used in the present embodiment, light emitted by a light-emitting diode or the like may be used, instead. The light-emitting device 300 emits laser light to the photosensitive drum 100, which has been uniformly charged by the charging roller 200, to form an electrostatic latent image on the surface of the photosensitive drum 100. The toner cartridge T storing toner t, which is developer, supplies the toner t to the development device 400 from a toner supply port T1. In the development device 400, the development roller 401, which is a developer bearing member, bears the toner t, which is the developer. An application unit 1340 applies a certain development bias to the development roller 401, and the development roller 401, which is in contact with the surface of the photosensitive drum 100 on which the electrostatic latent image has been formed, develops the electrostatic latent image. A sheet member 403 is provided in order to keep the toner t from leaking from around the development roller 401. A feed roller 800 supplies and conveys the recording material 900, such as a sheet of paper, to the transfer device (or the transfer unit) 500 in synchronization with the formation of the electrostatic latent image on the photosensitive drum 100. A high-voltage power supply 1200 applies a certain transfer bias to a transfer roller 501, which is the transfer unit, and the toner image on the photosensitive drum 100 is transferred onto the recording material 900. The recording material 900 onto which the toner image has been transferred is conveyed to the fixing device 700 and fixed. The recording material 900 is then discharged from the image forming apparatus A. The cleaning device 600 removes toner remaining on the photosensitive drum 100 after the transfer.

In the present embodiment, the process cartridge P and the toner cartridge T are used. In the process cartridge P, the photosensitive drum 100, the charging device, the development device 400, and the cleaning device 600 are integrated with one another. On the other hand, the toner cartridge T is a cartridge that stores the toner t and that supplies the toner t to the development device 400. The process cartridge P and the toner cartridge T are removably attached to the image forming apparatus A. In the present embodiment, the process cartridge P includes the development device 400, and the toner cartridge T is removably attached to the development device 400.

Alternatively, the photosensitive drum 100, the cleaning device 600 including a cleaning blade 601, and the development device 400 may be independently removably attached. Alternatively, the development device 400 may include the toner cartridge T.

In the present embodiment, detection of presence or absence of the toner cartridge T, which is the developer container, will be described. Alternatively, presence or absence of the development device 400 including both the developer container and the developer bearing member may be detected, or if a residual toner container 602 is regarded as a developer container, presence or absence of the cleaning device 600 may be detected. Furthermore, presence or absence of the process cartridge P including the developer container may be detected.

Next, a method for detecting presence or absence of the toner cartridge T, which is a characteristic of the present embodiment, will be described.

Contact and Separation Mechanism Between Photosensitive Drum 100 and Development Device 400

FIG. 2A is a schematic diagram illustrating a contact state of the process cartridge P, and FIG. 2B is a schematic diagram illustrating a separate state of the process cartridge P. As illustrated in FIG. 2A, the contact state refers to a state in which the photosensitive drum 100, which is the image bearing member, and the development roller 401, which is the developer bearing member, are in contact with each other. On the other hand, the separate state refers to a state in which the photosensitive drum 100 and the development roller 401 are not in contact with each other. As illustrated in FIG. 2B, the photosensitive drum 100 and the development roller 401 are separated from each other. In the present embodiment, the contact state changes to the separate state as the development roller 401 moves in an upper-right direction.

In the present embodiment, as illustrated in FIGS. 2A and 2B, the development roller 401, which is the developer bearing member, comes into contact with the photosensitive drum 100, which is the image bearing member, during development (FIG. 2A), and separates from the development roller 401 at other times (FIG. 2B). A position of the developer container at which the development roller 401 and the photosensitive drum 100 come into contact with each other is a position at which the light emitted from the light-emitting device 300 can reach the image bearing member and will be referred to as a "first position". A position of the developer container at which the development roller 401 and the photosensitive drum 100 are separated from each other is a position at which at least part of light emitted from the light-emitting device 300 is blocked and thus fails to reach the image bearing member and will be referred to as a "second position".

In the present embodiment, a movement mechanism 1000 that moves the developer container to either the first position or the second position is provided. In particular, in the present embodiment, the movement mechanism 1000 moves the developer container to a state (position) in which the photosensitive drum 100 and the development roller 401 are separated from each other and a state (position) in which the photosensitive drum 100 and the development roller 401 come into contact with each other. The movement mechanism 1000 is therefore a contact and separation mechanism that causes the image bearing member and the developer bearing member to come into contact with each other or separate from each other.

Although the photosensitive drum 100 and the development roller 401 can come into contact with each other and separate from each other in the present embodiment and the photosensitive drum 100 and the development roller 401 come into contact with each other during image formation (development), the photosensitive drum 100 and the development roller 401 need not come into contact with each other during development, instead. Alternatively, the cleaning device 600 may be omitted from the image forming apparatus A.

The photosensitive drum 100 and the charging device of the process cartridge P are fixed to the image forming apparatus A when a cartridge removal door D is closed. On the other hand, the development device 400 can rotate in a direction R, in which the development roller 401 and the photosensitive drum 100 come into contact with each other or separate from each other. The toner cartridge T is fixed to the development device 400 of the process cartridge P and moves as the development device 400 comes into contact or separates from the photosensitive drum 100.

In a normal state, a contact spring 400*a* applies stress to the development device 400 in a contact direction (+R), and the photosensitive drum 100 and the development roller 401 come into contact with each other. An image is formed in this state, and developer borne on the surface of the development roller 401 is transferred onto the photosensitive drum 100 in accordance with a latent image pattern of the photosensitive drum 100. On the other hand, if a command for performing a separating operation is output, the movement mechanism (separation cam) 1000, which is the contact and separation mechanism, mounted on the image forming apparatus A is rotated. By rotating the separation cam 1000, the development device 400 is pushed in a separation direction (−R). As a result, the development device 400 rotates and the photosensitive drum 100 and the development roller 401 separate from each other. At this time, the toner cartridge T also moves in accordance with the rotation of the development device 400.

As illustrated in FIGS. 2A and 2B, an upper surface of the toner cartridge T moves over the photosensitive drum 100 as the toner cartridge T rotates in accordance with the rotation of the separation cam 1000. The upper surface of the toner cartridge T inclines from a horizontal position. As the upper surface of the toner cartridge T moves over the photosensitive drum 100, laser light emitted from above is blocked (FIG. 2B).

Whether the upper surface of the toner cartridge T blocks the entirety of laser light or part of the laser light may be determined as necessary, details of which will be described later. The shape of the developer container can be determined in accordance with how the upper surface of the toner cartridge T blocks laser light.

Optical Path of Laser Light

A relationship between contacting and separating operations and laser light will be described. Arrows (LASER) illustrated at centers of FIGS. 2A and 2B indicate optical paths of laser light according to the present embodiment.

In order to form an image, laser light needs to be emitted to the photosensitive drum 100 when the photosensitive drum 100 and the development roller 401 are in contact with each other. When the photosensitive drum 100 and the development roller 401 are separated from each other, an image need not be formed. In order to detect presence or absence of the toner cartridge T or the shape of the toner cartridge T, which is a characteristic of the present embodiment, the toner cartridge T moves across the optical path of laser light to block the laser light emitted to the photosensitive drum 100 (FIG. 2B).

When the toner cartridge T is not mounted and the photosensitive drum 100 and the development roller 401 are separated from each other, laser light reaches the photosensitive drum 100 since the toner cartridge T does not block, in the optical path, the laser light emitted from the light-emitting device 300.

Difference in Potential of Photosensitive Drum 100 Depending on Presence or Absence of Toner Cartridge T When presence or absence of the toner cartridge T is detected, the charging roller 200 charges the photosensitive drum 100 to set the potential of the surface of the photosensitive drum 100 to a dark potential Vd. The dark potential Vd depends on the charging bias applied to the charging device, the potential of the drum cylinder 100A, and a dielectric constant and the thickness of the charge transfer layer 100*d*. In the present embodiment, the dark potential Vd is set at −500 V.

If laser light is emitted to the photosensitive drum 100 having the dark potential Vd, electron-hole pairs are formed in the charge generation layer 100*c*. Because of the dark potential Vd generated on the surface of the photosensitive drum 100 and an electric field formed by the grounded drum cylinder 100A, the holes move to the surface of the photosensitive drum 100 and the electrons move to the drum cylinder 100A. As the holes move to the surface of the photosensitive drum 100, the potential of the surface of the photosensitive drum 100 changes to a light potential Vl. In the present embodiment, the light potential Vl is set at −100 V.

In the separate state, if the toner cartridge T is mounted, the toner cartridge T blocks laser light, and the laser light does not reach the surface of the photosensitive drum 100. As a result, the surface of the photosensitive drum 100 remains charged, and the potential of the surface of the photosensitive drum 100 becomes the dark potential Vd. On the other hand, if the toner cartridge T is not mounted, laser light is not blocked and reaches the surface of the photosensitive drum 100. As a result, the potential of the surface of the photosensitive drum 100 becomes the light potential Vl. Presence or absence of the toner cartridge T is detected on the basis of this difference.

Method for Detecting Potential of Photosensitive Drum 100

If the potential of the surface of the photosensitive drum 100 and the potential of a surface of another member in contact with the photosensitive drum 100 are different from each other by a certain value or more, electrons are discharged so that the difference between the potential of the surface of the photosensitive drum 100 and the potential of the surface of the other member falls below the certain value. Electrons are discharged if there is a potential difference of 600 V or more between the photosensitive drum 100 and the other member. If the potential difference has been reduced to less than 600 V as a result of the discharge, the discharge ends. In the present embodiment, a certain bias is applied to members, and therefore a current caused by the discharge varies depending on whether the potential of the surface of the photosensitive drum 100 is the dark potential Vd or the light potential Vl.

In the present embodiment, a current supplied to the transfer device 500 is measured as a transfer current. A voltage of +1,000 V is applied to the transfer roller 501. If the potential of the surface of the photosensitive drum 100 is the dark potential Vd, a large transfer current flows compared to when the potential of the surface of the photosensitive drum 100 is the light potential Vl. If a measured value of the transfer current is a certain value or more, the CPU determines that the value of the transfer current is large, and estimates that the potential of the surface of the photosensitive drum 100 is the dark potential Vd. On the other hand, if the measured value of the transfer current is less than the certain value, the CPU determines that the value of the transfer current is small, and estimates that the potential of the surface of the photosensitive drum 100 is the light potential Vl.

In the image forming apparatus A according to the present embodiment, the current detection circuit 1100 is connected to the high-voltage power supply 1200, which generates the transfer bias. If the high-voltage power supply 1200 applies the certain transfer voltage to the transfer device 500, the current detection circuit 1100 can detect a transfer current Itr flowing into the transfer device 500. A value of the transfer current Itr detected by the current detection circuit 1100 is stored in the CPU, which is the arithmetic unit.

Figure 3:
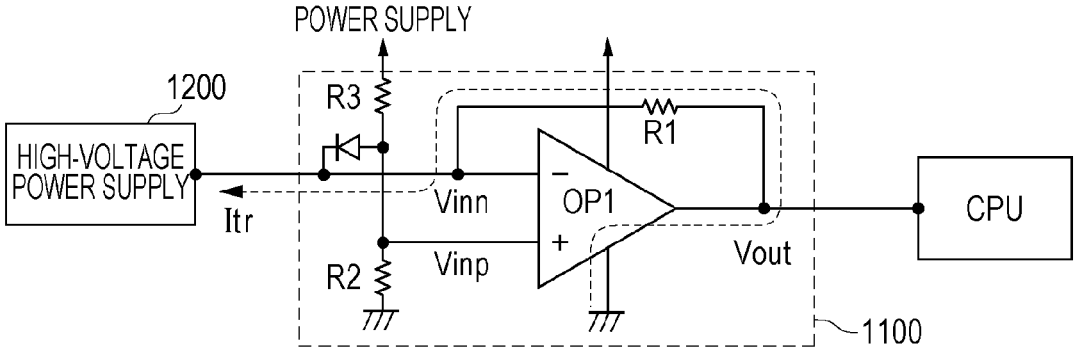
FIG. 3 is a schematic diagram illustrating a current detection circuit including an operational amplifier.

FIG. 3 is a schematic diagram illustrating a current detection circuit 1100 including an operational amplifier OP1 as an example of the current detection circuit 1100 in the present invention. The operational amplifier OP1 determines a potential Vout such that a difference between a potential Vinn and a potential Vinp becomes 0 V. In the present invention, resistors R2 and R3 divide a power supply voltage from a power supply to set the potential Vinp. The transfer current Itr is designed to flow into a transfer power supply Itr from the ground through the operational amplifier OP1 as indicated by a broken line illustrated in FIG. 3. If an transfer operation is not performed, Vout=Vinp. If the transfer operation is performed, the transfer current Itr flows through a path indicated by the broken line illustrated in FIG. 3 from the ground through the operational amplifier OP1. In consideration of a voltage drop (Itr×R1) at a resistor R1 due to the transfer current Itr, the potential Vout is determined as Vinp+Itr×R1. The CPU, which is the arithmetic unit, reads the potential Vout to calculate the transfer current Itr.

Although the potential of the surface of the photosensitive drum 100 is estimated or presence or absence of the toner cartridge T is detected by measuring the transfer current Itr in the present embodiment, the transfer current need not necessarily be used. In the present invention, it is sufficient that each member or device can obtain a signal, such as a current or a voltage, corresponding to the amount of discharge (electrons discharged from or received by the photosensitive drum 100). For example, although the transfer current may be used as a signal corresponding to the number of electrons discharged from the photosensitive drum 100, a current flowing into the charging device may be detected as a signal corresponding to the number of electrons received by the photosensitive drum 100, instead. Alternatively, a method may be used in which a current flowing between the photosensitive drum 100 and the ground is measured and a signal based on a discharge that occurs in the photosensitive drum 100 is obtained.

A value of a current generated in accordance with movement (discharge or reception) of electrons based on a discharge that occurs in the photosensitive drum 100, however, is small, and the transfer current in the present embodiment is about 20 μA. In order to obtain an accurate signal after the light-emitting device 300 emits laser light, therefore, a value of a current generated by discharging or receiving electrons near a position at which the laser light is emitted can be obtained.

When the charging device detects a charging current, the power supply can be turned off in order not to change the potential of the transfer roller 501 and the potential of the surface of the photosensitive drum 100 and to obtain values of current as many as possible. In addition, a negative bias voltage of −500 V or the like may be applied to the transfer roller 501.

More specifically, a voltage of −1,000 V is applied to the charging roller 200, and the development roller 401 and the photosensitive drum 100 are separated from each other. The power supply of the transfer roller 501 is turned off. The potential of the surface of the photosensitive drum 100 to which the light-emitting device 300 has emitted laser light is −100 V, and the potential of the surface of the photosensitive drum 100 to which the light-emitting device 300 has not emitted laser light is −500 V. The photosensitive drum 100 rotates and a position of the photosensitive drum 100 at which laser light has (not) been emitted comes close to a position at which the photosensitive drum 100 faces the charging roller 200. If the potential of the surface of the photosensitive drum 100 is −100 V, a discharge occurs and a signal is detected. On the other hand, even if the surface of the photosensitive drum 100 whose potential is −500 V comes close to the charging roller 200, a discharge hardly occurs since a potential difference from the charging roller 200 is 500 V.

Sequence

Figure 4:
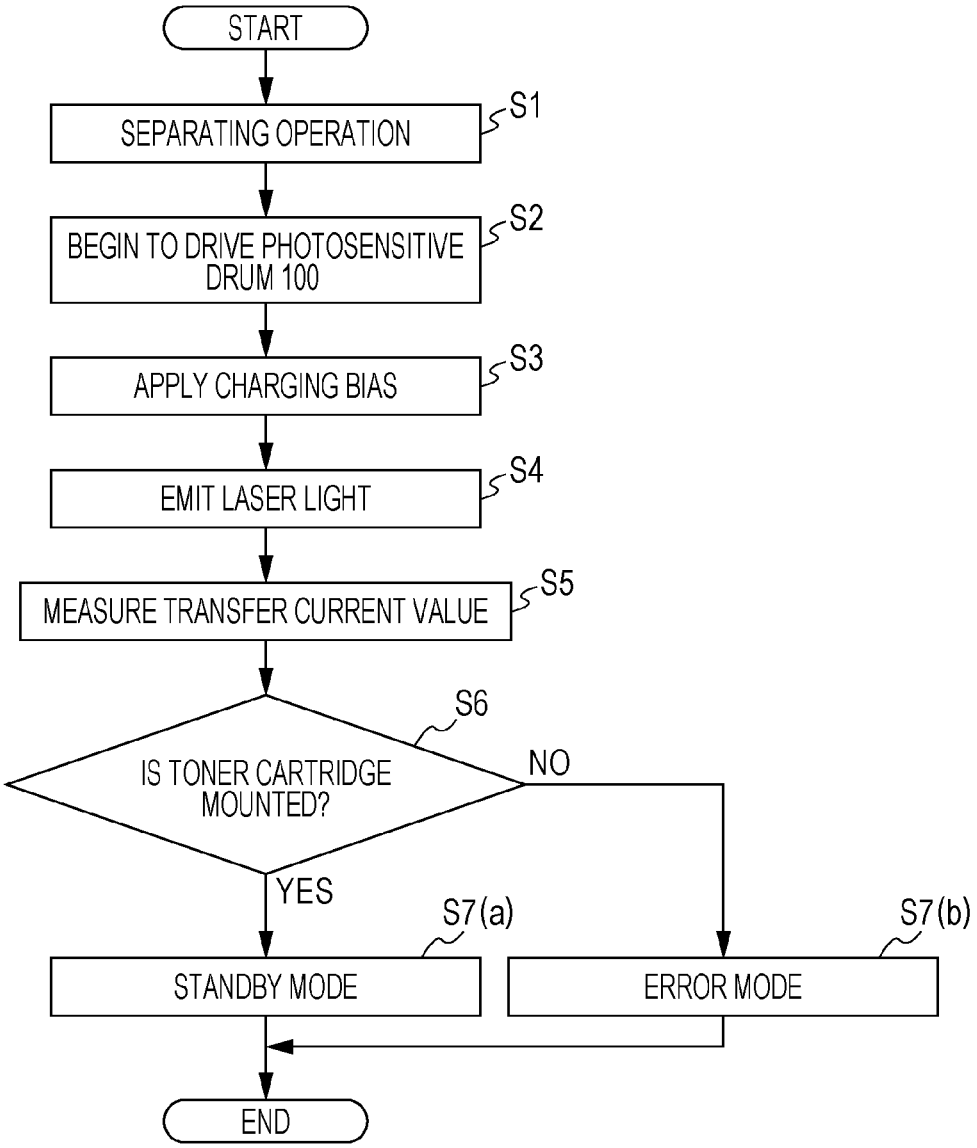
FIG. 4 is a flowchart illustrating a sequence for detecting presence or absence of the toner cartridge according to the first embodiment.

FIG. 4 is a flowchart illustrating a sequence for detecting presence or absence of the toner cartridge T according to the present embodiment.

This sequence begins when the image forming apparatus A is turned on or the cartridge removal door D is opened and then closed.

S1: in the present embodiment, since the photosensitive drum 100 and the development roller 401 are in contact with each other in the process cartridge P when another operation is not performed, a separating operation is performed.

S2: The photosensitive drum 100 is driven and rotates.

S3: Apply a certain bias to the charging device to generate the dark potential Vd on the surface of the photosensitive drum 100.

S4: Emit laser light to the surface of the photosensitive drum 100. The potential of the surface of the photosensitive drum 100 at this time is the dark potential Vd if the toner cartridge T is mounted (present) or the light potential Vl if the toner cartridge T is not mounted (absent).

S5: Apply a certain bias to the transfer device 500 and measure the value of the transfer current supplied to the transfer device 500.

S6: The CPU, which is the arithmetic unit, determines whether the toner cartridge T is mounted, on the basis of the measured value of the transfer current and Table.

TABLE

| Transfer current value | Photosensitive drum surface potential | Laser light | Toner cartridge |
|---|---|---|---|
| Large | Vd | Blocked | Mounted |
| Small | Vl | Reaches | Not mounted |

S7(*a*): If the toner cartridge T is mounted, the image forming apparatus A enters a standby mode.

S7(*b*): If the toner cartridge T is not mounted, the image forming apparatus A enters an error mode.

Using the sequence for detecting presence or absence of the toner cartridge T, the potential of the surface of the photosensitive drum 100, which changes in accordance with presence or absence of the toner cartridge T, can be estimated. It is therefore possible to detect whether the toner cartridge T is correctly mounted.

In an image forming apparatus including a plurality of cartridges, presence or absence of a cartridge can thus be detected without increasing the number of components. In addition, an image is not formed when the toner cartridge T is not mounted, thereby suppressing output of blank sheets and lack of toner. Furthermore, because developer functions as lubricant, the developer bearing member is not damaged due to friction between members, thereby suppressing output of sheets on which vertical streaks are formed.

If the charging device detects the charging current, S1 to S4 are performed in the same manner. In S5, the certain bias is not applied to the transfer roller 501, or the transfer roller 501 is separated from the photosensitive drum 100. After changes in the potential of a dark potential area of the photosensitive drum 100, in which laser light has been emitted, are suppressed, the photosensitive drum 100 rotates so that the dark potential area reaches the charging device. When the dark potential portion reaches the charging device, a discharge occurs due to a potential difference between the charging device and the dark potential portion. An electrical signal obtained by converting a current flowing through the charging device due to the discharge into a voltage is then transmitted to the arithmetic unit or the like. Thereafter, S6 and S7 are performed in the same manner.

Second Embodiment

In a second embodiment, a type of toner cartridge mounted on an image forming apparatus on which one of toner cartridges of different sizes can be mounted is determined on the basis of a difference between shapes of the toner cartridges. In the present embodiment, a standard toner cartridge TA or a large-capacity toner cartridge TX may be mounted. A method for detecting presence or absence of a toner cartridge used in the present embodiment is the same as that used in the first embodiment, and accordingly redundant description thereof is omitted.

The large-capacity toner cartridge TX stores more toner t than the standard toner cartridge TA. By using the large-capacity toner cartridge TX, a user who prints images on a large number of sheets need not frequently replace the toner cartridge T, which increases usability.

If the development device 400 operates, unintentional spreading or cracking of the toner t might occur due to friction between a component of the development device 400 and the toner t. It is also known that the toner t adheres to a component of the development device 400 and an imaging failure such as vertical streaks might occur. As a method for estimating the wearing out of the development device 400, a method is known in which the operating time of the development device 400, the number of sheets output from the image forming apparatus, or the like is accumulated and if an accumulated value exceeds a certain value, it is determined that the development device 400 has reached its end of life.

If toner cartridges T of different capacities are used as in the present embodiment, however, the wearing out of the development device 400 differs depending on the type of toner cartridge T used. In the present embodiment, therefore, a determination unit that determines the type of toner cartridge T mounted is provided. A value obtained by multiplying the operating time of the development device 400 by a coefficient determined in accordance with the type of toner cartridge T used is accumulated, and if the accumulated value exceeds a certain value, it is determined that the development device 400 has reached its end of life.

In doing so, even if different toner cartridges T are used, the end of life of the development device 400 can be accurately estimated, thereby making it possible to suppress occurrence of an imaging failure such as vertical streaks.

Method for Detecting Difference in Shape or Type of Cartridge

Figure 5A:
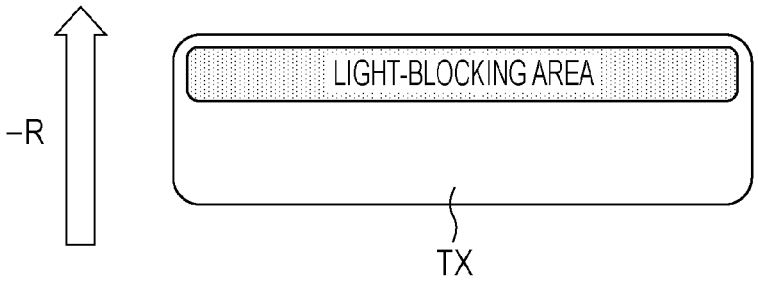
FIGS. 5A and 5B are conceptual diagrams illustrating cartridges viewed in a traveling direction of laser light according to a second embodiment.
Figure 5B:
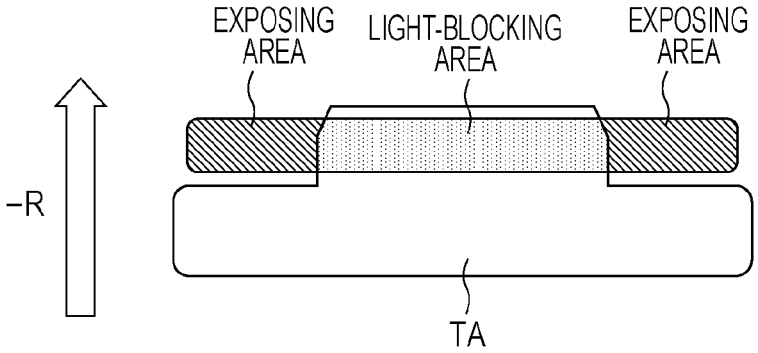

FIG. 5A is a conceptual diagram illustrating the large-capacity toner cartridge TX viewed in a traveling direction of laser light. FIG. 5B is a conceptual diagram illustrating the standard toner cartridge TA viewed in the traveling direction of laser light. Shaded areas illustrated in FIGS. 5A and 5B are light-blocking areas in which the toner cartridges T block laser light, and hatched areas illustrated in FIG. 5B are exposing areas in which the standard toner cartridge TA does not block laser light and the photosensitive drum 100 is exposed to the laser light.

Since the large-capacity toner cartridge TX stores more toner than the standard toner cartridge TA, the volume of the large-capacity toner cartridge TX is generally high. In the present embodiment, the light-blocking area of the large-capacity toner cartridge TX, whose volume is high, is larger than that of the standard toner cartridge TA.

Next, the determination unit that determines the type of toner cartridge T mounted, which is a characteristic of the present embodiment, will be described.

As illustrated in FIGS. 5A and 5B, the light-blocking area of the large-capacity toner cartridge TX is larger than that of the standard toner cartridge TA. When presence or absence of the toner cartridge T is detected as described in the first embodiment, area ratios of the light potential Vl and the dark potential Vd in the photosensitive drum 100 are different between the standard toner cartridge TA and the large-capacity toner cartridge TX since the area of the photosensitive drum 100 exposed to laser light is different between the standard toner cartridge TA and the large-capacity toner cartridge TX. In the following description, a ratio of the area of the dark potential Vd to the area of the entirety of a charged region in a longitudinal direction will be referred to as a "Vd area ratio a". In the present embodiment, the Vd area ratio a of the standard toner cartridge TA is 50%, and the Vd area ratio a of the large-capacity toner cartridge TX is 100%. If the standard toner cartridge TA or the large-capacity toner cartridge TX is not mounted on the image forming apparatus A, the Vd area ratio a is 0%.

The value of the transfer current Itr can be calculated from a value of a transfer current Id at a time when the potential of the entirety of the charged region of the photosensitive drum 100 is the dark potential Vd and a value of a transfer current Il at a time when the potential of the entirety of the charged region of the photosensitive drum 100 is the light potential Vl, and the Vd area ratio a. More specifically, the transfer current Itr is represented by the following expression (1).

$$Itr=a\times Id+(1-a)\times Il \quad (1)$$

For example, in the case of the large-capacity toner cartridge TX, the Vd area ratio a of the dark potential Vd is 100%, and a Vl area ratio of the light potential Vl is 0%. Since a transfer current of 20 μA is detected in the first embodiment, the value of the transfer current Id=20 (μA) if the potential of the entirety of a region of the photosensitive drum 100 used for the detection is the dark potential Vd. The value of the transfer current Il=10 (μA) if the potential of the entirety of the region of the photosensitive drum 100 used for the detection is the light potential Vl. In this case, the value of the transfer current Itr when the large-capacity toner cartridge TX is appropriately mounted is Itr (μA)=a×Id+(1−a)×Il=1×20+(1−1)×10=20 (μA). On the other hand, in the case of the standard toner cartridge TA, the Vd area ratio a of the dark potential Vd is 50%, and the Vl area ratio of the light potential Vl is 50%. The value of the transfer current Itr when the standard toner cartridge TA is appropriately mounted is Itr (μA)=a×Id+(1−a)×Il=0.5×20+(1−0.5)×10=15 (μA).

The detected current value is thus different between the standard toner cartridge TA and the large-capacity toner cartridge TX. The table is therefore stored in a storage unit of the image forming apparatus in advance, and the shape of a cartridge is determined on the basis of a current value by referring to the table. It is then possible to determine whether the cartridge mounted is the large-capacity toner cartridge TX or the standard toner cartridge TA on the basis of the shape of the cartridge.

The transfer roller 501, which corresponds to the transfer unit, according to the present embodiment is 12 mm in diameter and 220 mm in longitudinal length.

Although the type of toner cartridge T is determined after the shape of the toner cartridge T is determined in the present embodiment, the type of toner cartridge T may be directly determined, instead. Although the type of toner cartridge T mounted can be determined by measuring the value of the transfer current Itr, it is also possible to detect that the toner cartridge T is not mounted.

The type of toner cartridge T mounted can thus be detected. The wearing out of the development device 400 can be accurately estimated in accordance with the type of toner cartridge T mounted, thereby making it possible to suppress occurrence of an imaging failure such as vertical streaks.

Although the type of toner cartridge T is detected and then the wearing out of the development device 400 is estimated in the present embodiment, the type of toner cartridge T may be detected and then another type of control, such as control of various biases, may be performed using the obtained information, instead.

Modifications

Figure 7:
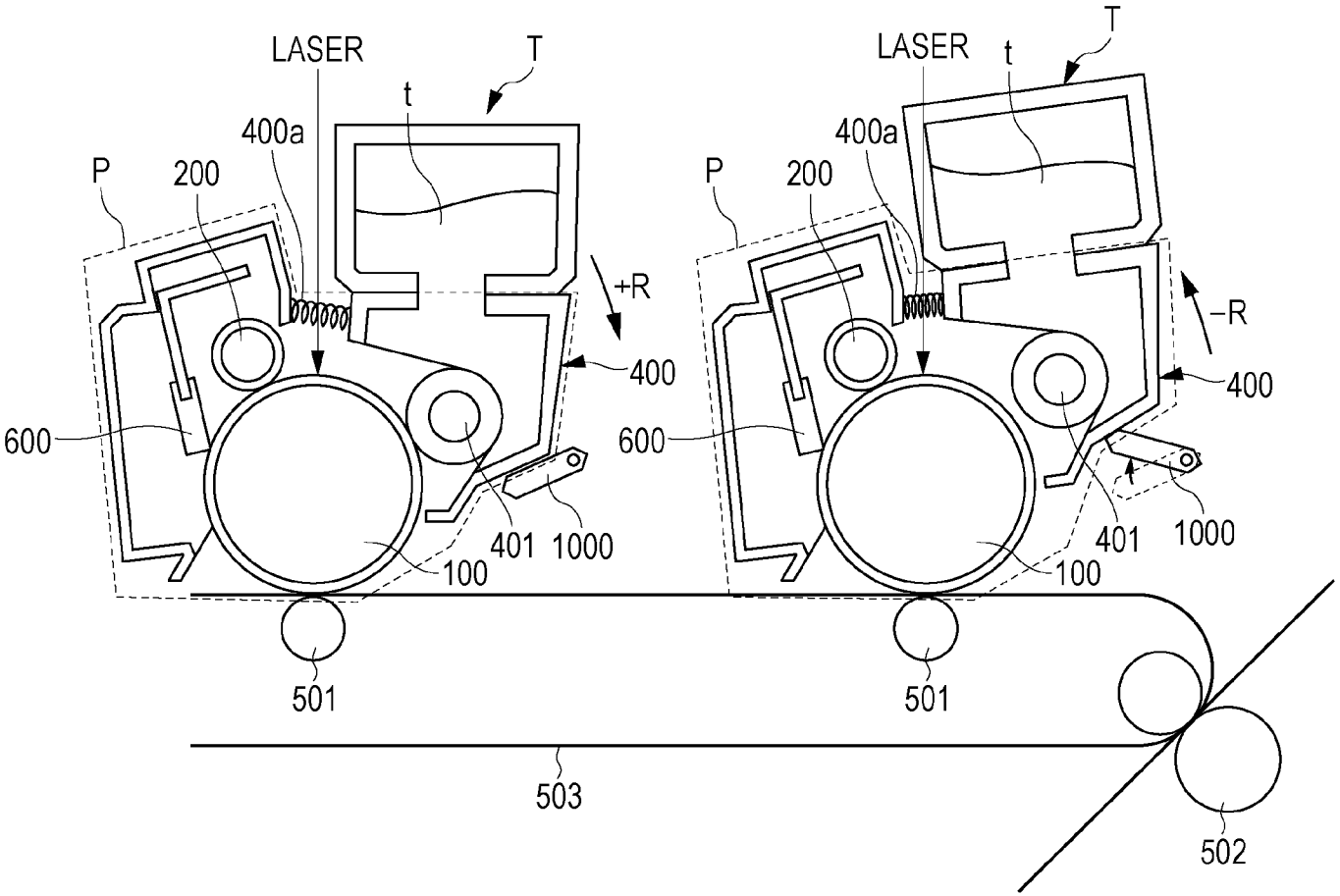
FIG. 7 is a schematic diagram illustrating an image forming apparatus including a plurality of image bearing members.

Although an image forming apparatus that forms an image using a single photosensitive drum has been described, the type of image forming apparatus used is not limited to this. For example, as illustrated in FIG. 7, the present invention can be applied to an image forming apparatus including a plurality of photosensitive drums. Although detection performed by a transfer unit that transfers an image onto a recording material from a photosensitive drum has been described, transfer rollers 501 that transfer developer onto a belt 503, which is an intermediate transfer member, from photosensitive drums 100 may detect current values, instead.

Although negative toner (negatively charged toner) has been described in the above embodiments, the present invention can be applied to an image forming apparatus that uses positive toner (positively charged toner). In the case of negative toner, a current corresponding to the number of electrons discharged from an image bearing member flows into a transfer unit, and a signal is detected by converting the current into a voltage. On the other hand, in the case of positive toner, a current corresponding to the number of electrons received by an image bearing member flows into a transfer unit, and a signal is detected by converting the current into a voltage.

As described above, according to the present invention, an image forming apparatus capable of detecting presence or absence of a cartridge or a shape of the cartridge without increasing the number of components can be provided.

While the present invention has been described with reference to exemplary embodiments, it is to be understood that the invention is not limited to the disclosed exemplary embodiments.

This application claims the benefit of Japanese Patent Application No. 2014-120003 filed Jun. 10, 2014, which is hereby incorporated by reference herein in its entirety.

What is claimed is:

1. An image forming apparatus comprising:

an image bearing member;

a light-emitting unit configured to emit light to the image bearing member that bears a developer image;

a developer container which is removably attached to the image forming apparatus and which contains developer;

a moving member configured to move the developer container attached to the image forming apparatus by moving between a shielding position and a non-shielding position;

an acquiring unit configured to acquire a signal corresponding to the number of electrons discharged from the image bearing member when irradiating a light from the light-emitting unit toward the image bearing member in a state where the moving member is at the shielding position; and a detecting unit configured to, based on the signal acquired by the acquiring unit, detect a presence or absence of the developer container or to detect a shape of the developer container, wherein, in a case where the moving member is at the non-shielding position, the developer container is at a first position where a light emitted from the light-emitting unit toward the image bearing member is not shielded by the developer container, and in a case where the moving member is at the shielding position, the developer container is at a second position where a light emitted from the light-emitting unit toward the image bearing member is shielded by at least a part of the developer container.

2. The image forming apparatus according to claim 1, wherein a transfer unit configured to transfer the developer onto a recording material or an intermediate transfer member from the image bearing member receives the electrons discharged from the image bearing member.

3. The image forming apparatus according to claim 1, wherein the signal corresponding to the number of electrons discharged from the image bearing member is a value related to a current flowing into the transfer unit.

4. The image forming apparatus according to claim 1, wherein a developer container of a different shape is detected by the detecting on the basis of the number of electrons discharged from the image bearing member.

5. The image forming apparatus according to claim 1, wherein the signal corresponding to the number of electrons is obtained by measuring surface potential of the image bearing member or from a current flowing between the image bearing member and ground.

6. The image forming apparatus according to claim 1, wherein, when the developer container is in the second position, the image bearing member and the developer bearing member are separated from each other, and wherein, when the developer container is in the first position, the image bearing member and the developer bearing member are in contact with each other.

7. The image forming apparatus according to claim 1, wherein the developer container is at least a part of development device including a developer bearing member that bears the developer.

8. The image forming apparatus according to claim 1, further comprising:

a process cartridge including the image bearing member;

a toner cartridge including the developer container, and wherein the toner cartridge is removably attached to the process cartridge.

9. An image forming apparatus comprising:

an image bearing member;

a light-emitting unit configured to emit light to the image bearing member that bears a developer image;

a developer container which is removably attached itself and which contains developer;

a moving member configured to move the developer container attached to the image forming apparatus by moving between a shielding position and a non-shielding position;

an acquiring unit configured to acquire a signal corresponding to the number of electrons received by the image bearing member when irradiating a light from the light-emitting unit toward the image bearing member in a state where the moving member is at the shielding position; and a detecting unit configured to, based on the signal acquired by the acquiring unit, detect a presence or absence of the developer container or to detect a shape of the developer container, wherein, in a case where the moving member is at the non-shielding position, the developer container is at a first position where a light emitted from the light-emitting unit toward the image bearing member is not shielded by the developer container, and in a case where the moving member is at the shielding position, the developer container is at a second position where a light emitted from the light-emitting unit toward the image bearing member is shielded by at least a part of the developer container.

10. The image forming apparatus according to claim 9, wherein a charging unit that charges the image bearing member discharges electrons to the image bearing member.

11. The image forming apparatus according to claim 9, wherein the signal corresponding to the number of electrons received by the image bearing member is a value related to a current flowing into the charging unit.

12. The image forming apparatus according to claim 9, wherein, when the developer container is in the second position, the image bearing member and the transfer unit are separated from each other.

13. The image forming apparatus according to claim 9, wherein a developer container of a different shape is detected by the detecting unit on the basis of the number of electrons received by the image bearing member.

14. The image forming apparatus according to claim 9, wherein the signal corresponding to the number of electrons is obtained by measuring surface potential of the image bearing member or from a current flowing between the image bearing member and ground.

15. The image forming apparatus according to claim 9, wherein, when the developer container is in the second position, the image bearing member and the developer bearing member are separated from each other, and wherein, when the developer container is in the second position, the image bearing member and the developer bearing member are in contact with each other.

16. The image forming apparatus according to claim 9, wherein the developer container is at least a part of development device including a developer bearing member that bears the developer.

17. The image forming apparatus according to claim 9, further comprising:

a process cartridge including the image bearing member;

a toner cartridge including the developer container, and wherein the toner cartridge is removably attached to the process cartridge.

18. An image forming apparatus comprising:

an image bearing member;

a light-emitting unit configured to emit light to the image bearing member that bears a developer image;

a developer container which is removably attached to the image forming apparatus and which contains developer;

a contacting member which is in contact with the image bearing member;

a moving member configured to move the developer container attached to the image forming apparatus by moving between a shielding position and a non-shielding position, wherein, in a case where the moving member is at the non-shielding position, the developer container is at a first position where a light emitted from the light-emitting unit toward the image bearing member is not shielded by the developer container, and in a case where the moving member is at the shielding position, the developer container is at a second position where a light emitted from the light-emitting unit toward the image bearing member is shielded by at least a part of the developer container, an acquiring unit configured to acquire a signal related to a current flowing into the contacting member when the contacting member contacts with a part of the image bearing member irradiated with a light by the light-emitting unit in a state where the moving member is at the shielding position; and a detecting unit configured to, based on the signal acquired by the acquiring unit, detect a presence or absence of the developer container or to detect a shape of the developer container.

19. The image forming apparatus according to claim 18, wherein the contacting member is a charging roller configured to charge the image bearing member.

* * * * *